United States Patent [19]

Way

[11] 3,998,005

[45] Dec. 21, 1976

[54] DEVICE WITH MOVABLE PARTS MADE FROM MATERIAL AND SENSITIVE TO MOIST GAS

[76] Inventor: Lee V. Way, Rte. 3, Box 333C, Wilmington, N.C. 28401

[22] Filed: Apr. 17, 1975

[21] Appl. No.: 569,190

[52] U.S. Cl. ..... 46/41; 40/37; 40/106.22; 40/218; 46/157; 272/8 N

[51] Int. Cl.[2] ..... A63H 13/02

[58] Field of Search ..... 46/124, 57, 157, 152, 46/41, 44, 1 R; 40/37, 37.1, 40, 106.22, 106.25, 106.41, 128, 218, 126; 272/8 N, 8 R, 27 N, 27 R

[56] References Cited

UNITED STATES PATENTS

| | | | |
|---|---|---|---|
| 589,173 | 8/1897 | Henke | 46/57 X |
| 1,282,212 | 10/1918 | Fulton | 40/37 X |
| 2,726,320 | 12/1955 | Damiano | 40/40 X |
| 2,760,302 | 8/1956 | Cheskin | 46/157 UX |
| 2,761,232 | 9/1956 | Garver | 46/47 X |
| 2,952,462 | 9/1960 | Planin | 46/152 X |
| 3,811,990 | 5/1974 | Stoff | 46/41 |

FOREIGN PATENTS OR APPLICATIONS

| | | | |
|---|---|---|---|
| 610,266 | 10/1948 | United Kingdom | 46/57 |

*Primary Examiner*—F. Barry Shay
*Attorney, Agent, or Firm*—B. B. Olive

[57] ABSTRACT

An amusement device employs a number of elements made from sheet material sensitive to moisture laden heat. The elements are shaped and mounted in a manner such that when placed in the path of moisture laden heat they tend to bend, curl, flap and the like and may be designed to simulate insect, e.g. butterfly, bird, and like motions for amusement purposes.

10 Claims, 7 Drawing Figures

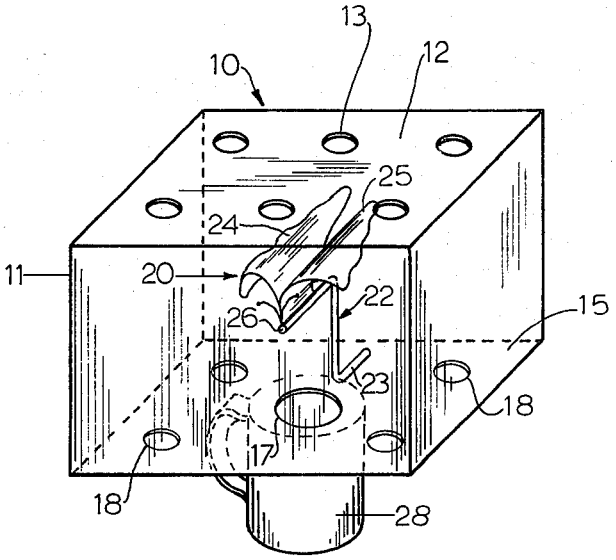
FIG. 1
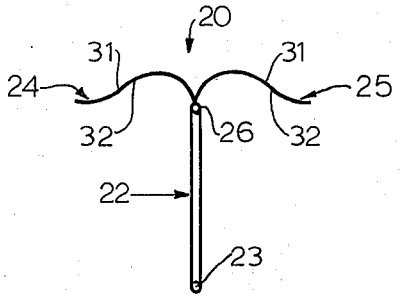
FIG. 2
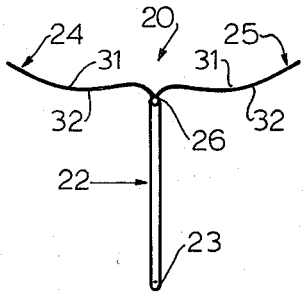
FIG. 3
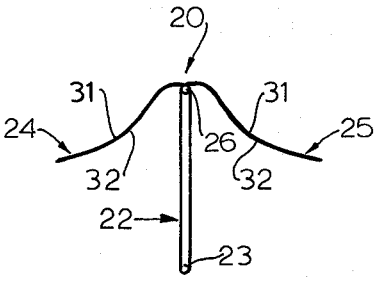
FIG. 4
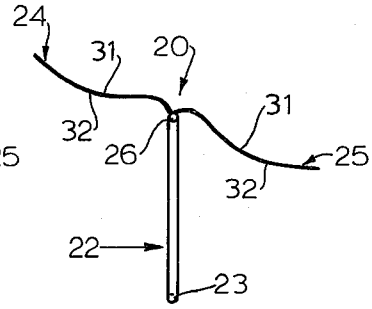
FIG. 5
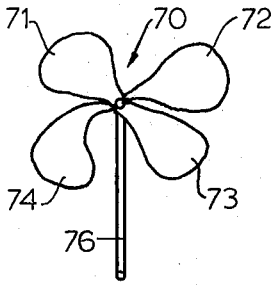
FIG. 7
FIG. 6
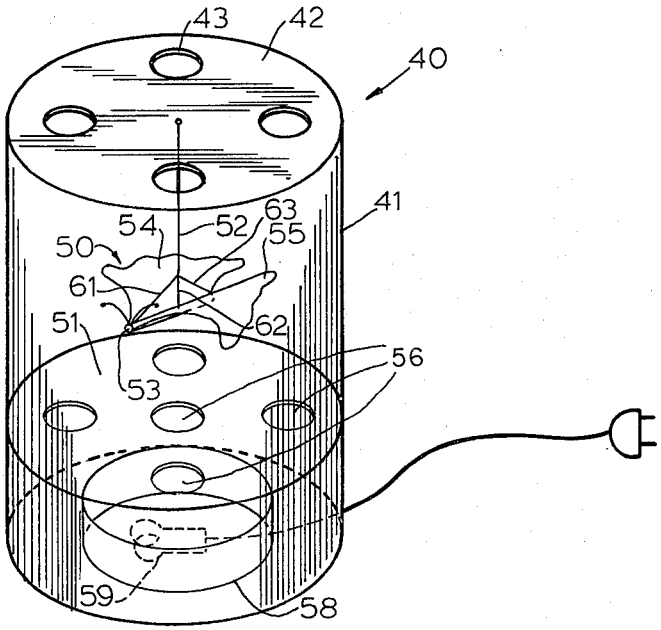

DEVICE WITH MOVABLE PARTS MADE FROM MATERIAL AND SENSITIVE TO MOIST GAS

BACKGROUND OF THE INVENTION

1. Field of the Invention

The invention relates to toys or amusement devices which depend upon air currents for motion. More specifically, the invention relates to a toy or amusement device having movable parts cut from a paper-like material whose shape changes in the presence of moisture laden heat.

2. Description of the Prior Art

It has long been known that wheel or other vent type toys will move in the presence of both heated and unheated air currents. However, it is believed that the prior art does not teach an amusement device having parts which are made from a moisture laden heat sensitive sheet material and which are mounted in a manner such that selected portions may move in the presence of moisture laden heat and without any air currents other than the convection current of the moisture laden air to which the device is exposed.

SUMMARY OF THE INVENTION

The amusement device of the present invention, in the embodiment used as an example, includes a simulated butterfly or other configuration which has wings or other projections of sheet material sensitive to moisture laden heat. The selected configuration is secured inside a transparent outer container. Hot, moist air is introduced into the bottom of the container, flows past the configuration and exits through holes in the top of the container. In the presence of this moisture laden heat the surfaces of the sheet material repeatedly curl and uncurl to simulate the flight of a butterfly or to give other desired effects in the case of alternative configurations.

DESCRIPTION OF THE DRAWINGS

FIG. 1 is a perspective view of a device simulating a butterfly according to the invention.

FIG. 2 is an elevation view of the butterfly wings in one position.

FIG. 3 is an elevation view of the butterfly wings in another position.

FIG. 4 is an elevation view of the butterfly wings in a further position.

FIG. 5 is an elevation view of the butterfly wings in another position.

FIG. 6 is a perspective view of an alternative embodiment.

FIG. 7 is a diagrammatic view of another embodiment.

DESCRIPTION OF THE PREFERRED EMBODIMENT

As the description will indicate the invention lends itself to almost unlimited numbers of forms and configurations and the following description is used merely by way of example.

Referring to FIG. 1, amusement device 10 comprises a box-like container 11 made from lightweight, transparent material such as a thin plastic. Top wall 12 is provided with a plurality of vent holes 13. Bottom wall 15 is provided with a large central hole 17 and a selected number of smaller vent holes 18 surrounding hole 17.

A support 22 is fixedly secured to bottom wall 15 by support base 23. Support 22 can be made from any suitable material which can be formed into the desired configuration. A bent pipe cleaner, glued to bottom wall 15, a piece of molded plastic or a strip of bent metal, similarly secured, will suffice.

A simulated butterfly 20 comprises wings 24, 25 which are secured to a horizontal portion 26 of support 22. Wings 24, 25 are secured only along a marginal edge portion. Thus, the remaining portions of wings 24, 25 are free to move within container 11. Wings 24, 25 are made from a thin paper which is particularly sensitive to moisture laden heat. In one embodiment the material used for wings 24, 25 was made from the type paper used as a protective cover over individual butter or margarine patties served in restaurants. Such paper is essentially a thin, relatively brittle paper coated with a wax-like substance. Although different papers will vary in sensitivity, it has been observed that virtually any non-absorbent paper is sensitive to moisture laden heat so that when a part is cut from such paper in an appropriate form and is appropriately mounted it will repeatedly curl and uncurl in the presence of the moisture laden heat and such motions are both amusing and interesting to observe.

Device 10 is adapted to be placed above any suitable source of moisture laden heat. FIG. 1 illustrates device 10 as it rests upon the top of a cup of hot coffee 28. The hot, moisture laden air rises from cup 28 through holes 17, 18 and into container 11 where it flows past wings 24, 25 of butterfly 20. The hot, moist air forms convection currents as it flows into container 11 and holes 13 in top wall 12 assure a continuous flow of such hot, moist air through the container, until the coffee cools.

As further illustrated in FIG. 2, what is believed to take place is that the hot moist air randomly flows past butterfly 20 so as to heat and cool top surfaces 31 and bottom surfaces 32 of wings 24, 25 at different times and at different rates. Thus, when bottom surface 32 is heated to a temperature hotter than that of top surface 31, bottom surface 32 will expand and wings 24, 25 will move upward as shown in FIG. 3. As the flow continues randomly around butterfly 20 the temperature of the top and bottom surfaces will equalize and eventually top surface 31 will be hotter so that wings 24, 25 will bend in a downward direction (FIG. 4). Of course, it has been observed that the motion of the air in container 11 can be such that wings 24, 25 will be bent in opposite directions at the same time (FIG. 5) which adds to the amusement value and interest.

It is believed that the best material for wings 24, 25 is a paper having a coating which will readily absorb heat from and dissipate heat to the heated, moist air current, and which is adhered to the paper so that the paper parts expand and contract with such heat transfer. It is also believed that best performance is obtained when the coatings on the top and bottom surfaces of the wings are sufficiently insulated from each other by the body of the paper so that heat will not readily flow through the paper to equalize the temperature on the two opposing surfaces. The above characteristics will allow the opposing surfaces to expand and contract independently so that the wings will bend to provide greatest interest and amusement.

It has been found that wings 24, 25 when formed as described will bend only in the presence of hot air with sufficient moisture to cause the wings to deform as described. The convection currents in the moist heat and the heat transfer characteristics of moist heat make it possible to have a constantly changing temperature differential between the opposing surfaces of the wings, whereas dry heat, so far as can be observed, merely maintains both surfaces at the same temperature and precludes any bending.

FIG. 6 illustrates an alternative embodiment of the invention. Amusement device 40 comprises a cylindrical container 41 made from transparent plastic or glass. Top wall 42 provides a plurality of vent holes 43. A simulated butterfly 50 is suspended from top wall 42 by thread or rod support 52 and auxiliary supports 61, 62, 63. At the base of container 41 is a shallow pan 58 for holding water. Pan 58 is heated by heater 59 which may be energized by a battery or household electricity to generate a source of heated, moist air. Between pan 58 and butterfly 50 is a perforated wall 51 which allows the moist, heated air so generated to pass from pan 58, through holes 56 in wall 51, over butterfly 50 and out vent holes 43. Butterfly 50 comprises body 53 and wings 54, 55 made from the sensitive sheet material described above.

In operation, pan 58 of the alternative embodiment is filled with water and heater 59 is turned on. As the water heats up, a flow of hot, moist air is generated and passes through holes 56 in wall 51 and activates wings 54, 55 in the same manner as described in the preferred embodiment. By appropriate use of color and design the movements of the wings can provide many hours of amusement for both child and adult.

It should be understood that the butterfly with movable wings is merely one configuration which can be made according to the invention. For example, FIG. 7 illustrates a flower 70 with a fixed stem 76 and movable petals 71, 72, 73, 74 made from sheet material sensitive to hot, moist air. Other examples include a fish with a movable tail, a man with movable arms, and a bird with movable wings. Many other variations may be devised. More than one movable piece can be placed within the same container, for example, a flock of birds. A container, of course, is not required.

While paper employed for wrapping margarine or butter has been used as an example, it is known that a wide variety of relatively non-absorbent, thin, sheet paper material is sensitive to moisture laden heat. While no plastic sheet material is known to respond in the manner described it is recognized that plastic sheet material could conceivably be fabricated for such purpose and with the characteristics described. The specific moisture, specific amount and degree of heat may also vary widely. For example, a very hot cup of coffee provides rapid action of the wings initially and less action as the coffee cools. Those skilled in the art may readily determine the range of temperature and moisture that gives best results for a particular sheet material and configuration. Also, it is recognized that while water is the preferred source of moisture since it is cheap and readily obtainable other liquids, e.g. certain alcohols, could conceivably be used and found compatible with particular types of sheet material and heat conditions. Thus, as with optimizing temperature and moisture, it is believed those skilled in the art can, from the information given, readily determine other liquids compatible with the invention.

Also, it is recognized that the heat serves to establish convection currents to carry the moist air and that the moisture, once on the figure elements, is a primary cause of movement as it evaporates, cools, etc. Thus, an appropriate liquid which evaporates without heat and which reacts with an appropriate sheet material formed and mounted in the manner described could conceivably be employed in the manner of the invention.

What is claimed is:

1. An amusement device comprising, in combination:

a. a support;

b. a source of relatively warm moisture laden gas;

c. a selected number of elements of predetermined configuration made from thin, flexible sheet material, each said element having means rendering it sensitive to moisture laden gas whereby contact of said elements with said gas produces relatively continual flexing movement of a portion of said element, each said element being secured to said support in such a manner that a portion of the sheet material remains free to move in the presence of said gas; and d. means for locating said support proximate said source.

2. The amusement device of claim 1 wherein said sheet material is thin, sheet paper material, said moisture laden gas is water vapor and said source of moisture laden gas is a supply of warm water.

3. The amusement device of claim 2 wherein said thin, sheet paper material is non-absorbent.

4. The amusement device of claim 1 wherein said support is mounted within a transparent container having a plurality of holes in the bottom and top surfaces thereof, said container being adapted to be positioned above said source of moisture laden gas whereby moisture laden gas is introduced into the holes in said bottom surface and allowed to flow past said elements.

5. The amusement device of claim 4 wherein said source of moisture laden gas is made internal with said container and is heated water.

6. An amusement device for producing relatively continual movement of thin, flexible sheet material elements thereon wherein said movement is actuated by bringing said elements in contact with relatively warm moisture laden gas, said device comprising in combination:

a. means for supporting elements of said device in space;

b. means mounting said supporting means by which the latter is adapted to be positioned proximate a mass of moisture laden gas, said mounting means including a member with a portion for appropriately positioning said device relative to a source of moisture laden gas, whereby said member will allow access of said moisture laden gas to the space around said support means; and c. a selected number of elements of predetermined configuration made from thin, flexible sheet material, each said element having means rendering it sensitive to moisture laden gas whereby contact of said elements with said gas produces relatively continual flexing movement of a portion of said element, each said element being secured to said support means in such a manner that a portion of the sheet material remains free to move in the presence of said gas.

7. The amusement device of claim 6 wherein said sheet material is thin, sheet paper material and said moisture laden gas includes water vapor to which said paper material is sensitive.

8. The amusement device of claim 7 wherein said thin, sheet paper material is non-absorbent.

9. The amusement device of claim 6 wherein said support means is mounted within a transparent container having a plurality of holes in the bottom surfaces thereof, said container being adapted to be positioned above a source of relatively warm moisture laden gas whereby moisture laden gas is introduced into the holes in said bottom surface and allowed to flow past said elements.

10. The amusement device of claim 9 including a source of relatively warm moisture laden gas made integral with said container, said source containing heated water.

* * * * *

UNITED STATES PATENT OFFICE

CERTIFICATE OF CORRECTION

Patent No. 3,998,005 Dated December 21, 1976

Inventor(s) Lee V. Way

It is certified that error appears in the above-identified patent and that said Letters Patent are hereby corrected as shown below:

Col. 4, line 35, "internal" should be --integral--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*